United States Patent [19]

Liwski

[11] Patent Number: 4,797,521

[45] Date of Patent: Jan. 10, 1989

[54] MICROWAVE OVEN COOKWARE PEDESTAL

[76] Inventor: Henrietta M. Liwski, Rte. 1, Box 365, Readville, Va. 22539

[21] Appl. No.: 116,355

[22] Filed: Nov. 4, 1987

[51] Int. Cl.[4] ..... H05B 6/80

[52] U.S. Cl. ..... 219/10.55 E; 219/10.55 F; 99/DIG. 14

[58] Field of Search ..... 219/10.55 E, 10.55 F, 219/10.55 R; 99/DIG. 14, 451, 644, 646 C; 426/241, 243; 126/390

[56] References Cited

U.S. PATENT DOCUMENTS 2,600,566 6/1952 Moffett, Jr. ..... 219/10.55 E
4,210,124 7/1980 Husslein et al. ..... 219/10.55 E X
4,563,561 1/1986 Vaeth et al. ..... 219/10.55 E
4,612,431 9/1986 Brown et al. ..... 219/10.55 E

*Primary Examiner*—Philip H. Leung
*Attorney, Agent, or Firm*—Richard C. Litman

[57] ABSTRACT

A cookware pedestal for supporting food vessels in a microwave oven includes two pan-shaped dishes joined together at their bases in a substantially mirror arrangement. Each disk is provided with a different diameter rim to a secure surface for supporting food vessels of various sizes. The pedestal supports vessels in a horizontal and elevated disposition and in the case of vessels having metallic coatings on the bottom, maintains such coating isolated to allow browning or frying of foods without any damage to the pedestal or surrounding oven chamber.

2 Claims, 2 Drawing Sheets

10
15
42
24
16
15'
14

MICROWAVE OVEN COOKWARE PEDESTAL

BACKGROUND OF THE INVENTION

This invention relates generally, to a cookware supporting apparatus and more particularly, to an improved cookware pedestal for supporting various sizes of cookware as used in the cooking chamber of a microwave oven.

The use of microwave ovens for cooking has increased significantly due to the improved speed with which these ovens can cook various foods and because of the minimal amount of energy expended in cooking, in comparison to traditional cooking methods. One limitation in the use of microwave ovens is that only certain types of cooking utensils may safely be used within the cooking chamber of the oven in view of the parameters involved. The utensils must be made of materials which neither reflect nor absorb appreciable amounts of microwave energy. This means that metallic utensils cannot be used in microwave ovens without recognizing the resultant inherent dangers. Another problem confronting persons cooking with microwave ovens is the uneven distribution of microwave energy throughout the oven chamber itself.

In most microwave ovens, the highest level of energy is experienced in the middle of the chamber while less energy is available at the level of the chamber floor or bottom. In order to avoid material which either reflect or absorb excessive amounts of microwave energy, it has become common to manufacture microwave oven cooking utensils of glass, ceramics or plastics.

Examples of prior art devices in this art field include the following:

| U.S. Pat. No. | Inventor |
|---|---|
| 4,210,124 | Husslein et al |
| 4,249,464 | Hansen |
| 4,539,455 | Colato et al |
| 4,653,461 | Eke |

The above prior art disclose examples of non-metallic cooking vessels as well as the concept of providing means for elevating the level of utensils in a microwave oven to optimally utilize the available microwave energy. None of these prior art examples, whether considered singly or in any combination, are seen to even remotely suggest the improvement as presented by the instant invention.

Independent of the microwave oven context, various companies have developed ceramic cookware vessels with bottoms which are partially coated with a metallic layer for utilization on the flat counter stovetops employing inductive heating. Likewise, vessels are produced to achieve browning and even the frying of foods in a microwave oven and wherein the vessel bottom is coated with a metallic layer such as of zinc oxide. An example of such cookware is the skillet produced and sold by the Corning Glass Company of Corning, N.Y., U.S.A. The problem encountered in the use of such vessels in a microwave oven is that the metal oxide coating on the vessel bottom absorbs an excessive amount of microwave energy and becomes extremely hot. The result is that the heated coating readily attacks any plastic surface upon which the cookware is supported. This includes not only the bottom shelf or base of the cooking chamber but also any intermediate support member such as a trivet or turntable.

By the present invention, an improved pedestal is provided which avoids both of the described limitations associated with microwave ovens in general and at the same time permits the user to take advantage of the inherent ability of metal coated skillets to fry or brown foods within a microwave oven.

The instant device is preferably made of plastics and therefore neither reflects nor absorbs appreciable amounts of microwave energy. Furthermore, the present apparatus properly supports varied sizes of cookware at an elated position, toward the center portion of a microwave oven chamber, where cooking can be accomplished most efficiently. most importantly, because the present device makes contact solely with the outer portion of the cooperating cookware, which does not have the metallic coating thereon, the pedestal can be used successfully with a variety of cooking utensils to allow for browning or frying of foods in a microwave oven, without damage to surrounding components due to the significant heat generated by the oxide coated cookware bottom.

SUMMARY OF THE INVENTION

A unitary cookware pedestal is formed by two pan-shaped dishes inverted relative one another and joined together at their respective bases to provide a substantially mirror-symmetrical arrangement, except for the variation in the diameter of the two dishes. The cookware pedestal keeps the food vessel supported in a horizontal manner and elevated above the bottom of the oven chamber, in an area where the intensity of the microwave energy is the greatest.

The advantages of the cookware pedestal are most striking when it is utilized in conjunction with food vessels which have their base treated with a metal oxide coating such as those manufactured by the Corning Glass Company. In this respect, the cookware pedestal supports the food vessel above the plastics base or turntable without coming in contact with the metal coated portion of the cookware. Thus, because the pedestal only comes in contact with those regions of the cookware which have not been treated with the oxide coating, it allows the cookware to function as a frying skillet without damaging either the cookware pedestal or the microwave oven.

Another object of the present invention is to provide a unitary pan-shaped pedestal having alternate supporting rims of differing diameters and which can accommodate various sizes of cookware merely by inverting the pedestal.

Still another object of the present invention is to provide rims extending horizontally from the lip of each of a pair of joined pan-shaped dishes to support cookware placed thereon and wherein a metal coating on the cookware bottom is free of contact with any structure.

BRIEF DESCRIPTION OF THE DRAWINGS

Similar reference characters designate corresponding parts throughout the several views of the drawings.

DETAILED DESCRIPTION OF THE PREFERRED EMBODIMENT

The cookware pedestal of the present invention, generally designated 10, will be understood to comprise a unitary, fixed device made of a material compatible with the parameters associated with exposure within the confines of an operating microwave oven.

Figure 1:
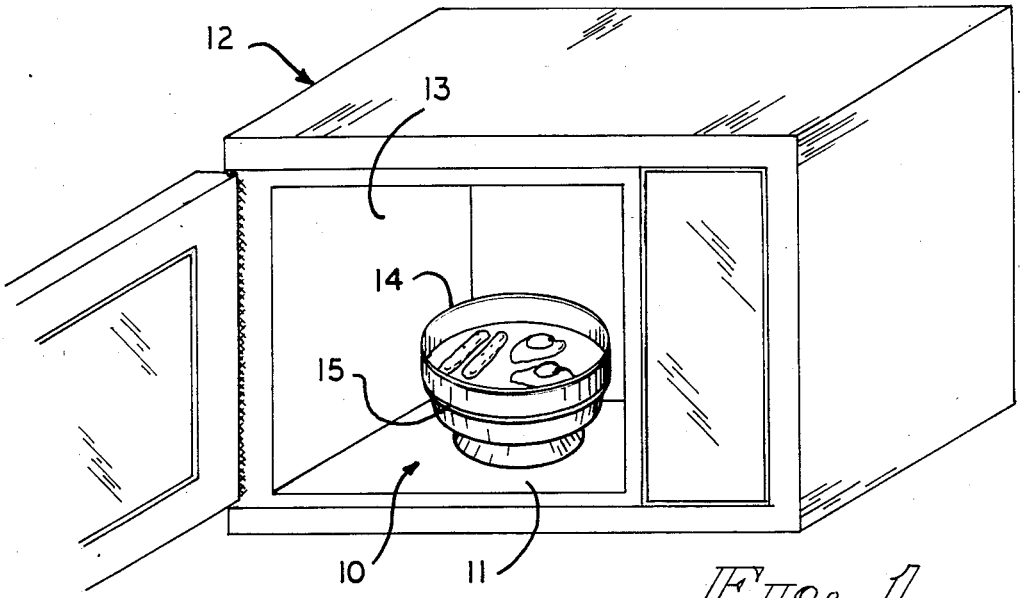
FIG. 1 is a perspective view of a microwave oven showing the cookware pedestal in use within the oven cooking chamber.

The instant pedestal 10 is shown in FIG. 1 of the drawings as utilized with a typical microwave oven 12 and wherein the frying of bacon and eggs is accomplished within a ceramic cooking vessel or skillet 14 through use of the present unique apparatus. As is apparent from this view, the cookware pedestal 10 raises the food vessel 14 substantially above the floor 11 of the oven chamber of compartment 13, toward the center portion thereof, where cooking can be accomplished most efficiently. With this arrangement. The cookware pedestal 10 can be used to brown or fry foods within a microwave oven without damaging either the pedestal 10 or the oven 12 and particularly in cases where the food utensil bottom surface is provided with a metallic coating.

Figure 2:
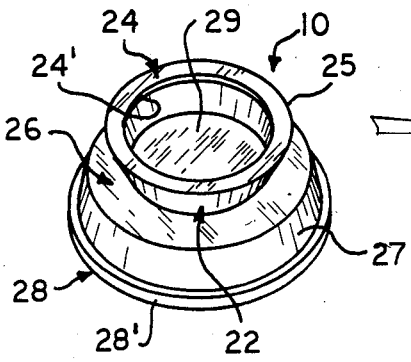
FIG. 2 is a perspective view of the cookware pedestal in an alternate position to that as shown in FIG. 1.

In the enlarged view of FIG. 2, the pedestal is shown more clearly and will be understood to comprise a smaller pan-shaped dish 22 having a horizontal rim 24 extending inwardly from the outer edge 25 to provide an inwardly directed lip 24' defining a circular platform to positively support the planar bottom wall or surface 15 of a food vessel 14. In this representation, the smaller pan-shaped dish 22 is positioned as the upper part of the integral cookware pedestal 10 where it serves to support food vessels having a relatively small bottom wall 15. A larger pan-shaped dish 26 is provided as the lower or supporting portion of the pedestal and will be seen to be constructed somewhat similar to the dish 22 except that at least its diameter is greater than that of the dish 22. This larger dish 26 also includes a horizontal rim 28 but which extends outwardly from the pan side wall 27 and terminating in an outwardly directed lip 28' to enable the support of larger dimensioned food vessels 14. In this manner, the pedestal 10 may be selectively inverted to position either the larger dish rim 28 or smaller dish rim 24 in the upper, or food vessel supporting position. The width or radial extent of the two rims 24,28 is substantial, so as to insure an adequate platform for securely supporting cooking vessels disposed thereupon. This width may be of any suitable extent but preferably equal at least one inch.

Figure 3:
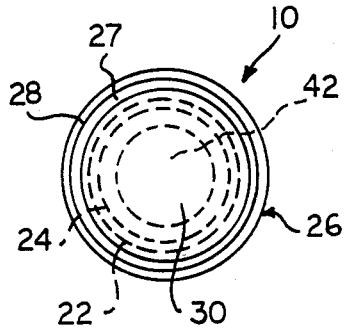
FIG. 3 is a top plan view of the cookware pedestal of FIG. 1.
Figure 4:
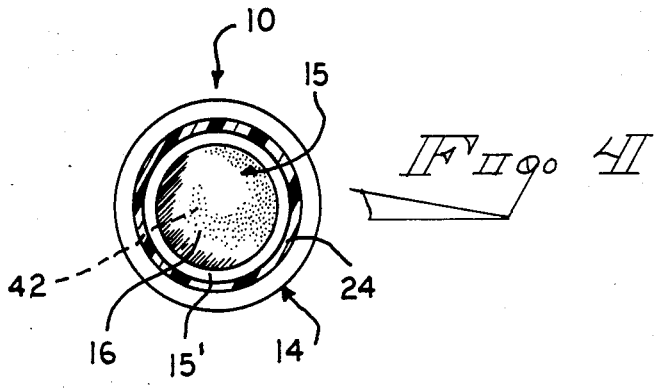
FIG. 4 is a bottom plan view of a skillet showing the pedestal in contact only with the area of the skillet bottom not provided with a metallic coating.

The two juxtaposed dishes 22 and 26 are co-joined at their respective bases 29,30 as indicated by the common area 42 in FIGS. 3 and 4.

When viewed in plan such as shown in FIG. 3, the pedestal 10 will be seen to include the two supporting rims 24, 28 disposed with decidedly different diameters whereby two concentric supporting surfaces are provided. With this arrangement, the user selects the appropriate dish rim 24 or 28 to employ, depending upon the diameter of the vessel 14 to be utilized. Since the two dishes 22,26 form fixed components of the unitary pedestal 10, the device is merely inverted as necessary to place the desired diameter rim in the uppermost position. The unitary nature of the pedestal is assured due to the co-joining of the two dishes 22,26 in the area of their juxtaposed bottoms, as indicated by the area 42 in FIG. 3.

The most outstanding aspect of the present device involves its use with cookware having a coating of metallic oxide 16 or the like on its bottom surface 15. As shown in FIG. 4 of the drawings, those coating 16 is circular and defines a diameter less than the diameter or length/width of the vessel bottom 15. this insures a free or uncoated area 15' outside the boundary of the coated area 16 and which is engaged by the pedestal rim 24 or 28 to support a vessel 14 within the oven chamber 13. In this manner, during the cooking cycle within the oven 12, microwave energy will be absorbed by the coating 16 thereby substantially raising the temperature of the corresponding area of the vessel bottom 15 to brown or fry food contained within the vessel and without any damage to either the pedestal 10 or structure of the oven chamber. The foregoing is insured since the very surface of the vessel bottom that is significantly heated is supported in an isolated manner by the respective dish rim 24 or 28.

The foregoing is considered as illustrative only of the principles of the invention. Further, since numerous modifications will readily occur to those skilled in the art, it is not desired to limit the invention to the exact construction and operation shown and described, and accordingly, all suitable modifications and equivalents which may be resorted to, fall within the scope of the invention.

I claim:

1. A pedestal adapted for use in a microwave oven cooking chamber for supporting cookware having a metallic coating on its bottom and wherein the coating occupies the central area of the cookware bottom and leaving an outer bottom perimeter free of the coating, comprising:

a pair of pan-shaped dished having bottom walls joined to one another to define a unitary member, each said dish provided with a rim defining a horizontal planar cookware supporting surface vertically spaced from the respective said bottom wall, said rims of said two dishes defining two different diameters, and said pedestal constructed of plastics material devoid of reflective or absorbent coatings and substantially inert to the effects of microwave radiation, whereby said pedestal may be selectively inverted prior to placing within the chamber of a microwave oven to utilize either diameter rim for supporting the outer bottom perimeter of cookware at an elevated position within the oven with the cookware coating disposed in an isolated manner within the confines of said dish rim.

2. A pedestal according to claim 1 wherein, said rims comprise circular surfaces having a radial extent of at least one-half inch

* * * * *